US008582398B2

(12) United States Patent
Goeller

(10) Patent No.: US 8,582,398 B2
(45) Date of Patent: Nov. 12, 2013

(54) STRIKING MECHANISM WITH A GONG NOISE INSULATOR ARRANGEMENT FOR A WATCH

(75) Inventor: Eric Goeller, Les Hôpitaux Vieux (FR)

(73) Assignee: Montres Breguet SA, L'Abbaye (CH)

( * ) Notice: Subject to any disclaimer, the term of this patent is extended or adjusted under 35 U.S.C. 154(b) by 553 days.

(21) Appl. No.: 12/941,452

(22) Filed: Nov. 8, 2010

(65) Prior Publication Data

US 2011/0110200 A1 May 12, 2011

(30) Foreign Application Priority Data

Nov. 6, 2009 (EP) ..... 09175266

(51) Int. Cl.
*G04B 21/06* (2006.01)

(52) U.S. Cl.
USPC ..... 368/243; 368/272; 368/315

(58) Field of Classification Search
USPC ..... 368/243, 272, 315
See application file for complete search history.

(56) References Cited

U.S. PATENT DOCUMENTS

| | | | | |
|---|---|---|---|---|
| 7,021,819 | B2 * | 4/2006 | Schmiedchen | 368/147 |
| 7,545,706 | B2 * | 6/2009 | Candaux | 368/243 |
| 7,708,458 | B2 * | 5/2010 | Karapatis | 368/315 |
| 8,130,597 | B2 * | 3/2012 | Favre et al. | 368/244 |
| 2008/0074956 | A1 * | 3/2008 | Karapatis | 368/243 |

FOREIGN PATENT DOCUMENTS

| | | |
|---|---|---|
| CH | 313 202 | 3/1956 |
| EP | 1 914 606 A1 | 4/2008 |
| FR | 1 042 749 | 11/1953 |
| FR | 1 418 634 | 11/1965 |

OTHER PUBLICATIONS

European Search Report issued in corresponding application No. EP09 17 5266, completed Mar. 12, 2010.

* cited by examiner

*Primary Examiner* — Renee Luebke
*Assistant Examiner* — Jason Collins
(74) *Attorney, Agent, or Firm* — Griffin & Szipl, P.C.

(57) ABSTRACT

The striking mechanism (1) of a watch includes at least one gong (3, 4, 5) fixed at one end to a gong-carrier (2) integral with a bottom plate, at least one hammer mounted on the plate for striking the gong, and a gong noise insulator arrangement (6, 7). At least one insulator part (6) of the insulator arrangement is configured to be moved in rotation by drive means (9, 11, 12) so that one U-shaped portion (16) of the insulator part comes into contact with the gong in an idle mode or is at a distance from the gong in striking mode. A rotatably mounted, opposite insulator counterpart (7) with a rod (17) is provided so that the insulator part (6) and the opposite counterpart form a clamp for imprisoning the gong in an idle mode.

15 Claims, 3 Drawing Sheets

STRIKING MECHANISM WITH A GONG NOISE INSULATOR ARRANGEMENT FOR A WATCH

This application claims priority from European Patent Application No. 09175266.7 filed Nov. 6, 2009, the entire disclosure of which is incorporated herein by reference.

FIELD OF THE INVENTION

The invention concerns a striking mechanism fitted with a gong noise insulator arrangement for a watch. The striking mechanism generally includes at least one gong secured at one end to a gong-carrier integral with a bottom plate, and at least one hammer mounted on the bottom plate to strike the gong in desired strike periods. The gong noise insulator arrangement is configured to prevent any inadvertent ringing of the gong in an idle mode particularly following a shock against neighbouring components in the watch case.

BACKGROUND OF THE INVENTION

Within the field of watchmaking, a traditional architecture is used to make movements, which are fitted with striking mechanisms, such as minute repeaters. In these embodiments, the gong or gongs used are each formed by a metal wire generally of circular shape. The metal wire of each gong is placed in a parallel plane to the watch dial and to the bottom plate on which it is mounted. The metal wire can normally be arranged around a movement in the watch frame. One end of each gong is fixed, for example by soldering, to a gong-carrier integral with the bottom plate, which may be a single carrier for all the gongs. The other end of each gong can generally be free.

The striking mechanism of the watch includes a hammer actuated at predetermined moments. The vibration of the gong is produced by the impact of the hammer on the gong in proximity to the gong-carrier. The hammer generally makes a partial rotation in the plane of the gong so as to cause the gong to vibrate in its plane. Part of the gong vibration is transmitted to the bottom plate by the torsion of the gong-carrier. The bottom plate then vibrates in a parallel plane to the plane of the gong.

Depending upon the shape and dimension of the gong or gongs used in a striking mechanism, the gong(s) may inadvertently ring in an idle mode against neighbouring metal parts following an abrupt movement of the watch. The longer the length of the gong, such as a cathedral type gong including at least two windings around the watch movement, the more likely the problem of inadvertent ringing or accidental resonance is to occur. This constitutes a drawback for a luxury watch fitted with this type of striking mechanism.

To overcome this problem, it is already known to use one or more noise insulators for one or more gongs of a striking mechanism, as disclosed in EP Patent Application No. 1 914 606. In this patent application, the striking mechanism includes two cathedral gongs, fixed via one of their ends to a single gong-carrier. At least one insert is provided between the gong windings, and rings are regularly distributed over each gong. However, this insulator arrangement has the drawback of having a multitude of static insulator elements in the watch case, in direct proximity to each gong, which may create some interference when each gong is in strike mode. Moreover, all of these noise insulator elements are detrimental to the aesthetic quality of striking mechanism of this type, fitted with this noise insulator arrangement for each gong.

Means for attenuating the noise of the gong or membrane are also known from the state of the art from CH Patent No. 313 202 and FR Patent No. 1 042 749, but there is no mention of a gong noise insulator arrangement for preventing any inadvertent ringing of the gong in an idle mode.

SUMMARY OF THE INVENTION

It is thus an object of the invention to overcome the drawbacks of the state of the art by providing a striking mechanism for a gong fitted with a gong noise insulator arrangement, which is easy to implement yet lets the gong vibrate freely in strike mode, and preserves all the aesthetic qualities of said striking mechanism.

The invention therefore concerns the aforecited striking mechanism for a watch, which includes at least one gong fixed at one end to a gong-carrier integral with a bottom plate, at least one hammer mounted on the bottom plate for striking the gong, and a gong noise insulator arrangement configured to prevent any inadvertent ringing of the gong in an idle mode, wherein at least one insulator part of the insulator arrangement is configured to be moved by drive means so that one portion of the insulator part is in proximity of the gong in an idle mode or at a distance from the gong in striking mode.

Particular embodiments of the striking mechanism are defined in the dependent claims 2 to 15.

One advantage of the striking mechanism fitted with the gong noise insulator arrangement lies in the fact that at least one insulator part can be moved by drive means so as to occupy a position in proximity to the gong in an idle mode or a position at a distance from the gong in a strike mode. Preferably, the insulator part is rotatably mounted on a bottom plate of the striking mechanism and driven by the drive means. This insulator part preferably includes at least one U-shaped sector in order to come into direct contact with an intermediate part of the gong in an idle mode.

Advantageously, the gong noise insulator arrangement also includes an opposite insulator counterpart for forming a clamp with the insulator part to imprison an intermediate part of the gong in an idle mode. Imprisoning the intermediate part of the gong with the clamp limits the free length of said gong and therefore its flexibility. This prevents any accidental resonance when there is an abrupt movement of the watch when the striking mechanism is in an idle mode.

Advantageously, the insulator part includes a number of U-shaped sectors matching the number of gongs of the striking mechanism or to the number of gong windings, so that each U-shaped sector comes into contact with the corresponding gong in an idle mode. A rod of the counterpart comes into contact with all of the gongs directly opposite the set of U-shaped sectors open towards the outside of the insulator part. At least the parts of the insulator part and counterpart in contact with the gongs are made in an elastically deformable plastic material so as to act as noise insulation for the gong or gongs.

BRIEF DESCRIPTION OF THE DRAWINGS

The objects, advantages and features of the striking mechanism provided with the gong noise insulator arrangement will appear more clearly in the following description of at least one non-limiting embodiment with reference to the drawings, in which.

DETAILED DESCRIPTION OF THE INVENTION

In the following description, all those parts of the watch striking mechanism that are well known in this technical field will be described only briefly.

Figure 1A:
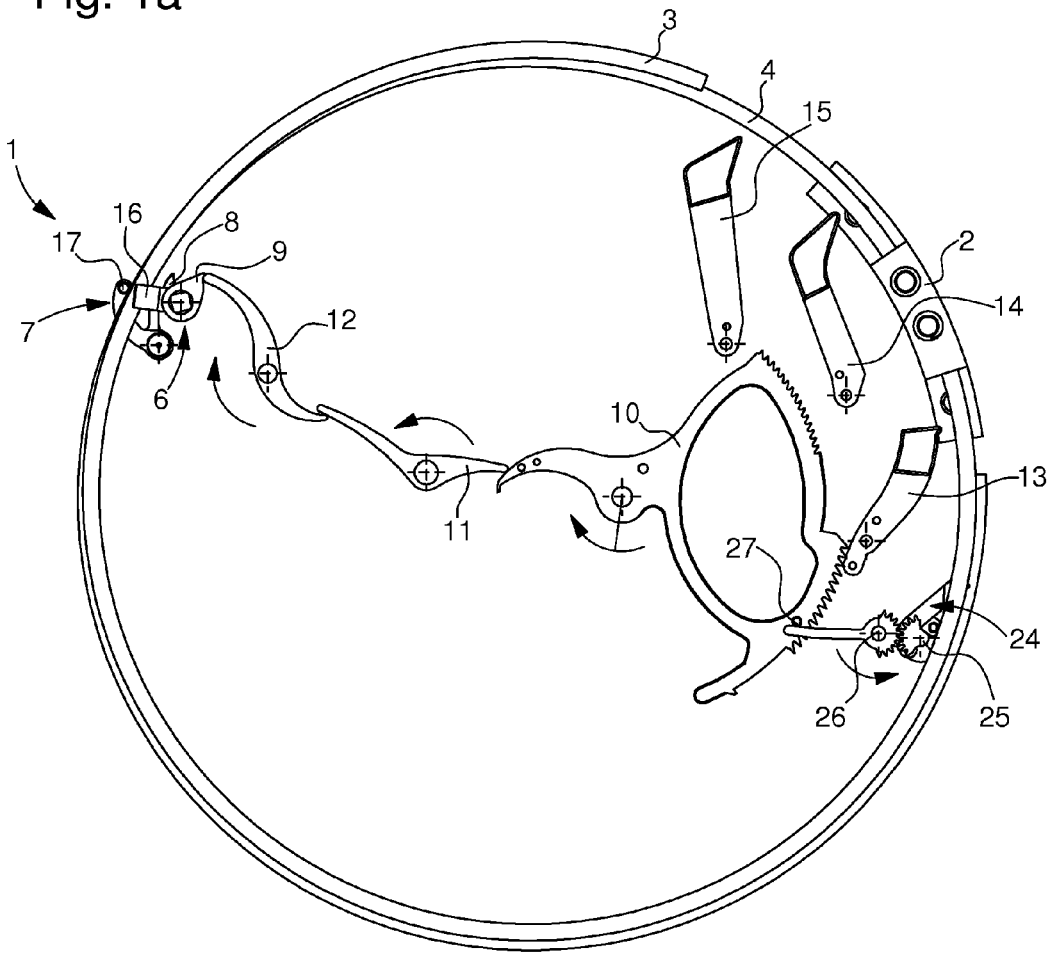
FIGS. 1*a* and 1*b* show a top view and a side view of certain parts of the striking mechanism with the gong noise insulator arrangement in an idle mode.
Figure 1B:
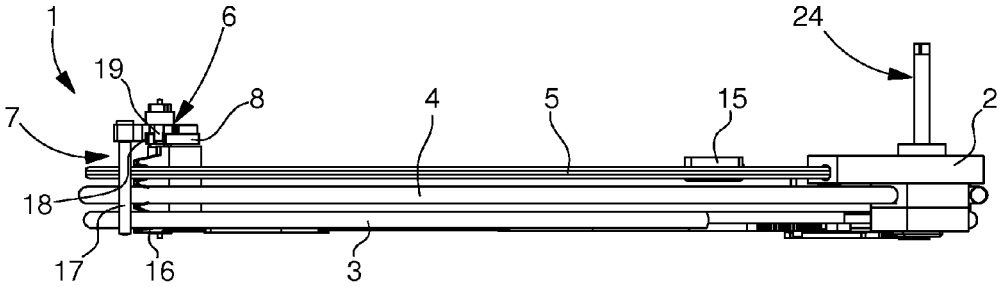

FIGS. 1*a* and 1*b* show a top view and side view of the striking mechanism 1 of a watch with a gong noise insulator arrangement when the mechanism is in an idle mode. To avoid overloading the Figures, only the essential elements of striking mechanism 1 with the noise insulator arrangement for gongs 3, 4, 5 are shown.

In this embodiment striking mechanism 1 includes three gongs 3, 4 and 5. Each of these gongs 3, 4 and 5 is connected via one end thereof to a gong-carrier 2, which is integral with a bottom plate (not shown). This bottom plate is normally underneath the elements shown in FIG. 1*a*, and above gong-carrier 2 in the inverted side view of the striking mechanism in FIG. 1*b*. Preferably, one of the ends of each gong is connected to a single gong-carrier 2, although several gong-carriers 2 could have been envisaged. The other end of each gong is free to move.

The gongs may define a portion of a circle, as shown in FIG. 1*a*, so as to surround a watch movement (not shown), which may be mounted on the bottom plate of striking mechanism 1. This portion of a circle may describe a toric portion with an angle, for example, of between 180° or less and 360°, but preferably close to 330° in this embodiment. The three gongs 3, 4 and 5 are mounted one on top of the other, at a sufficient distance from each other and with the portion thereof that defines a plane parallel to the watch dial and bottom plate.

As this striking mechanism includes three gongs made of metallic material, such as a precious metal or steel or metallic glass, and the shape of each gong is adapted to produce a determined sound, three hammers 13, 14 and 15 are rotatably mounted on the bottom plate. The first hammer 13 is for striking the first gong 3 normally in proximity to gong-carrier 2. The second hammer 14 is for striking the second gong 4, while the third hammer 15 is for striking the third gong 5. In an idle mode, the hammers are held at a distance from each gong by a spring element (not shown).

Striking mechanism 1 also includes a gong noise insulator arrangement, which is driven by drive means, which generally includes a set of levers or pivoting parts 10, 11, 12, 26, as explained below. The gong noise insulator arrangement mainly includes an insulator part 6, which is rotatably mounted on the bottom plate. This insulator part preferably rotates along an approximately perpendicular axis to the bottom plate, but it is also possible to envisage the axis of rotation not being perpendicular to the plane of the bottom plate. One portion 16 of said insulator part 6 is intended to be arranged in proximity to the gongs in an idle mode as shown in FIGS. 1*a* and 1*b*, but preferably in direct contact with the three gongs 3, 4 and 5. This insulator part 6 thus includes three U-shaped sectors open towards the exterior of the insulator part and arranged one on top of the other along the axis of rotation of said part. The space between each U-shaped sector matches the space between each gong 3, 4 and 5 to be insulated in idle mode.

The gong noise insulator arrangement also includes an opposite insulator counterpart 7, which is also rotatably mounted in proximity to the insulator part so as to form, with said part, a clamp for imprisoning the gongs in an idle mode. The axis of rotation of this counterpart is preferably perpendicular to the plane of the bottom plate but, like the insulator part, may also not be perpendicular to the plate in an embodiment that is not shown. The axes of rotation of opposite insulator counterpart 7 and insulator part 6 are located on the inner side of the gongs. This counterpart includes a rod 17 to be arranged in proximity to gongs 3, 4 and 5 in an idle mode and preferably in direct contact with insulator part 6 on an intermediate part of each gong. Rod 17 of the counterpart comes into contact with an external side of the gongs. However, the portion of insulator part 6 provided with U-shaped sectors 16, opposite said rod 17 of counterpart 7, comes into contact with an inner side of each gong in the idle mode.

Figure 2A:
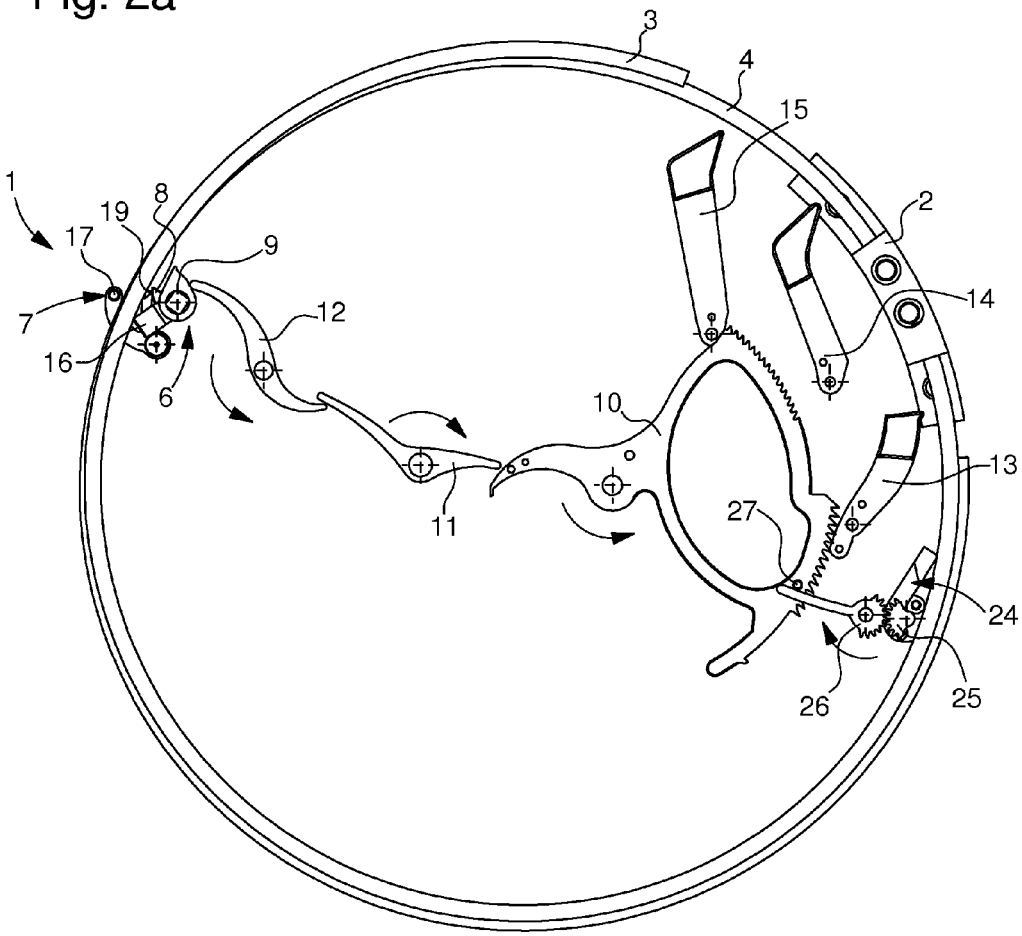
FIGS. 2*a* and 2*b* show a top view and a side view of certain parts of the striking mechanism with the gong noise insulator arrangement in a striking mode.
Figure 2B:
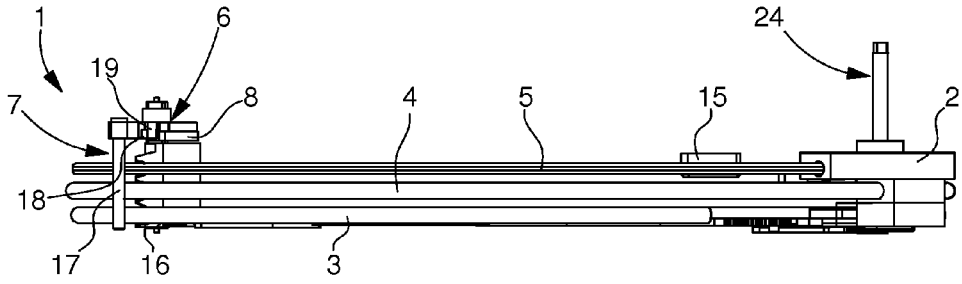
Figure 3:
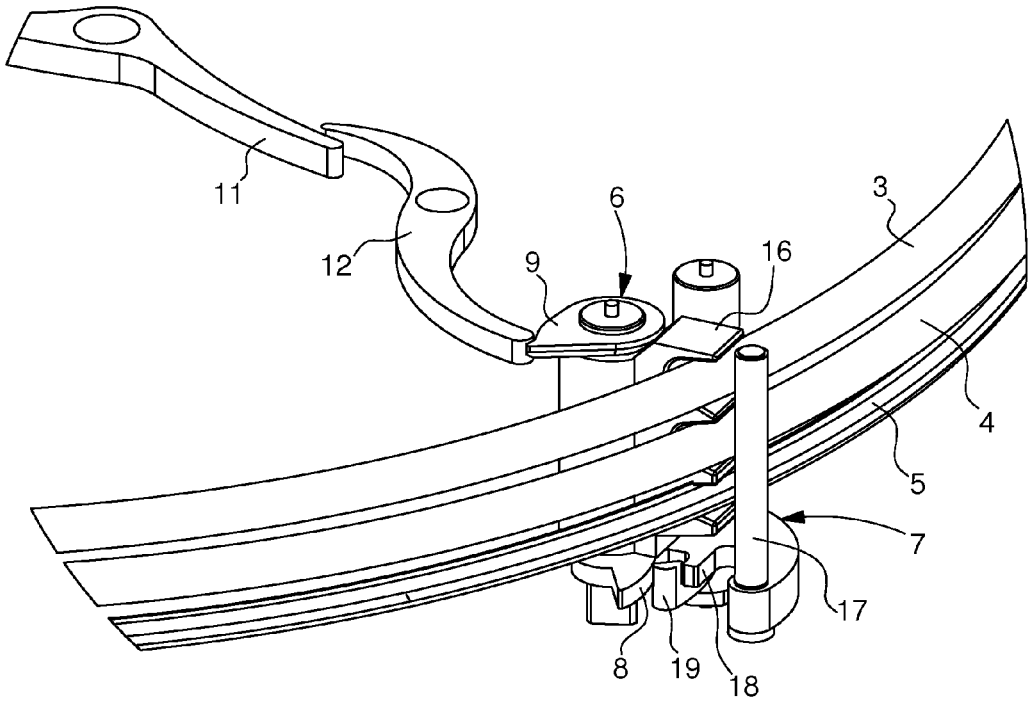
FIG. 3 shows an enlarged three dimensional view of the clamp shaped part of the gong noise insulator arrangement of the striking mechanism in an idle mode.

Opposite counterpart 7 also includes an arm at the end of which a finger 19 is arranged, as shown in more detail in FIG. 3, in a partial, three dimensional view of the striking mechanism with the gong noise insulator arrangement. Finger 19 of the counterpart is held by a spring element against a first cam 8 of the insulator part 6 on the axis of rotation of the insulator part. When the insulator part rotates clockwise until contact with gongs 3, 4 and 5, rod 17 of counterpart 7 is moved closer to the gongs via first cam 8 in idle mode. Rod 17 preferably comes into contact with the gongs. However, in the striking mode as shown in FIGS. 2*a* and 2*b* explained below, rod 17 of counterpart 7 is moved away from the gongs by a projecting portion of first cam 8.

Opposite insulator counterpart 7 and insulator part 6 are driven in rotation over a short distance by drive means. To achieve this, insulator part 6 further includes a second cam 9 arranged on an opposite side to first cam 8 along the axis of rotation of part 6 as shown in FIG. 3. A first lever or pivoting part 12 of the drive means is held in contact, via a first end, against the outer surface of second cam 9. This first lever 12 is driven in rotation clockwise at the second end thereof as shown in FIG. 1*a*, by a first end of a second lever 11. This second lever 11 is itself driven in rotation anti-clockwise at a second end thereof by an arm of a lever 10 in the form of a minute-rack, which is actuated clockwise to act on the first and second levers 12 and 11.

It is to be noted that in order for first lever 12 to remain in contact with second cam 9, a return spring (not shown) is provided, acting in the anticlockwise direction of the striking mechanism shown in FIG. 1*a*. Another return spring (not shown) is also provided on insulator part 6, particularly on the axis of rotation thereof, for acting in the clockwise direction. Without the action of second lever 11 and minute-rack 10, the return force of the spring of first lever 12 is much stronger than the return force of the spring of insulator part 6 and also of the spring element of counterpart 7. In these conditions, as shown in FIGS. 2*a* and 2*b*, first lever 12, abutting via a first end against second cam 9, will drive in rotation insulator part 6, and opposite insulator counterpart 7 into a position away from the gongs in strike mode. Since the arrangement of the spring elements in the drive means is well known in this technical field, it will not be described in greater detail.

The noise insulator arrangement for gongs 3, 4 and 5 further includes an insulator element 24 rotatably mounted on the bottom plate and arranged diametrically opposite insulator part 6 and the opposite insulator counterpart 7. This insulator element 24 is also driven in rotation by minute-rack 10.

A catch 27 of the minute-rack drives anticlockwise an arm of a toothed wheel 26, which is also rotatably mounted on the bottom plate against a return spring. This toothed wheel meshes directly with a toothed sector 25, arranged on the axis of rotation of insulator element 24.

In the idle mode, minute-rack 10 forces insulator element 24 to come into contact with an end part of gong 4, which is located between the other two gongs 3 and 5. This insulator element pushes the end of intermediate gong 4 slightly outwards. The part in contact with the insulator element may also be a U-shaped sector to match an external surface of intermediate gong 4. This insulator element 24 prevents the end of intermediate gong 4 from coming into contact with one or other of gongs 3 and 5 when the watch makes an abrupt movement. Of course, the U-shaped sector portion of this insulator element need only be made in an elastically deformable plastic material like portion 16 in contact of insulator part 6 and rod 17 of opposite insulator counterpart 7.

Figure 4:
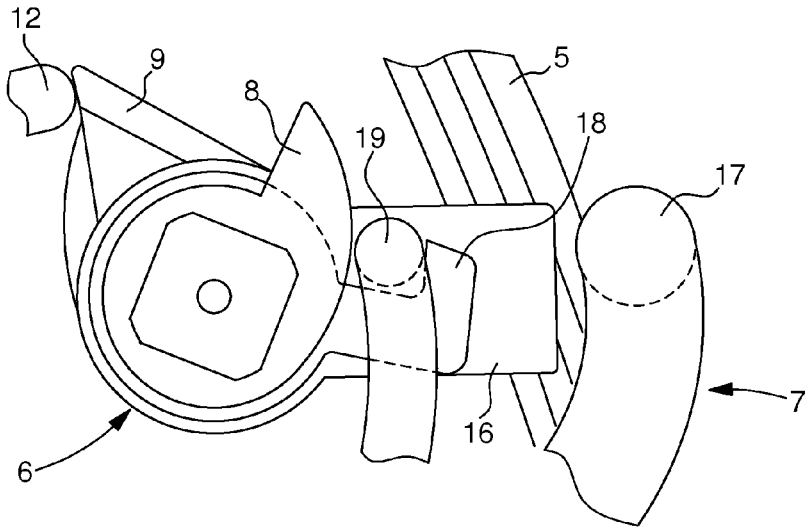
FIG. 4 shows an enlarged bottom view of the clamp shaped part of the gong noise insulator arrangement of the striking mechanism in an idle mode.

In the idle mode and as shown in more detail in FIG. 4, finger 19 is in abutment, lodged in a bolt 18 fixed on the axis of rotation of insulator part 6. This bolt rotates with the insulator part, first cam 8 and second cam 9. In this position, the clamp is held closed by inserting finger 19 in bolt 18. This prevents the clamp opening with the inertia of the gongs. However, the retaining force of the finger in the bolt is much less than the force of the drive means for changing from the idle mode to strike mode, as explained below.

FIGS. 2*a* and 2*b*, as mentioned above, show a top view and a side view of striking mechanism 1 of a watch with a gong noise insulator arrangement when the mechanism is in strike mode. Since the elements referenced are the same as those described for FIGS. 1*a* and 1*b*, the description of these elements will not be repeated in detail.

The essential difference of the striking mechanism 1 shown in FIGS. 2*a* and 2*b*, is that the insulator part 6, opposite insulator counterpart 7 and insulator element 24 are moved by the drive means to occupy a position away from gongs 3, 4 and 5. The rotation of levers 10 to 12 and toothed wheel 26 is shown in FIGS. 2*a* and 2*b* to illustrate clearly the movement of each lever for the configuration of striking mechanism 1 in strike mode. As explained above, first lever 12 with the return spring thereof forces insulator part 6 to rotate anti-clockwise to occupy the position away from gongs 3, 4 and 5, just like opposite insulator counterpart 7.

Owing to the gong noise insulator arrangement described above, when there is any abrupt movement of the watch, which includes this type of striking mechanism 1, this prevents each gong from unintentionally coming into contact with any metallic components of the watch, and the generally metallic watch case and from producing undesired ringing.

From the description that has just been given, several variants of the striking mechanism provided with a noise insulator arrangement for one or more gongs can be devised by those skilled in the art without departing from the scope of the invention as defined by the claims. Several clamps may be distributed along the gong(s) to imprison and insulate said gongs from neighbouring metallic elements. One or more gongs may include several superposed windings around the watch movement and each be secured to a different gong-carrier. The insulator part and the opposite insulator counterpart can be moved by the drive means in a movement of translation in the idle mode and in strike mode.

What is claimed is:

1. A striking mechanism for a watch, which includes at least one gong fixed at one end to a gong-carrier integral with a bottom plate, at least one hammer mounted on the bottom plate for striking the gong, and a gong noise insulator arrangement configured to prevent any inadvertent ringing of the gong in an idle mode, wherein at least one insulator part of the insulator arrangement is configured to be moved by drive means so that one portion of the insulator part is in proximity of the gong in an idle mode or at a distance from the gong in striking mode.

2. The striking mechanism according to claim 1, wherein the insulator part is rotatably mounted on the bottom plate along an approximately perpendicular axis to said plate.

3. The striking mechanism according to claim 1, wherein one portion of the insulator part comes into contact with an intermediate part of the gong in an idle mode.

4. The striking mechanism according to claim 1, wherein the gong defines at least one portion of a circle or portion of a rectangle above the bottom plate and around a watch movement inside a case of said watch, and wherein the insulator part is located on the inner side of the portion of a circle or portion of a rectangle so that one portion of the insulator part comes into contact with an intermediate part of said gong in the idle mode.

5. The striking mechanism according to claim 1, wherein the insulator part includes a U-shaped sector for coming into contact with the gong in an idle mode and surrounding an outer surface of the intermediate part of the gong.

6. The striking mechanism according to claim 1, wherein the insulator arrangement also includes an opposite insulator counterpart, configured to be moved by the drive means so that a rod-shaped part of the counterpart is in proximity to an outer side of the gong in an idle mode and at a distance from the gong in strike mode.

7. The striking mechanism according to claim 1, wherein the counterpart is rotatably mounted on the bottom plate along an approximately perpendicular axis to said plate, and opposite the insulator part, and wherein the opposite insulator counterpart and the insulator part form a clamp for imprisoning the intermediate part of the gong between portions of the insulator part and opposite insulator counterpart, in an idle mode.

8. The striking mechanism according to claim 7, wherein the insulator part includes a first cam against which a finger of the opposite insulator counterpart is held in contact to drive, during rotation of the first cam, a rod-shaped portion of the counterpart and a portion of the insulator part against the intermediate part of the gong in an idle mode or away from the intermediate part of the gong in striking mode.

9. The striking mechanism according to claim 8, wherein the drive means also includes a second cam arranged on the axis of the insulator part and a set of levers, one of which is held in contact on the second cam so as to drive the insulator part via the second cam against the gong in an idle mode or away from the gong in a striking mode.

10. The striking mechanism according to claim 8, wherein a bolt is mounted on the axis of rotation of the insulator part in combination with the first cam so that the finger of the opposite insulator counterpart abuts inside the bolt in the idle mode.

11. The striking mechanism according to claim 1, wherein it includes a gong fixed at one end to the gong-carrier and defining at least two windings around a watch movement, and wherein the insulator part includes at least two U-shaped sectors arranged one on top of the other along the axis of rotation so that the first sector comes into contact on one portion of the first winding and the second sector comes into contact on a portion of the second winding of the gong in an idle mode.

12. The striking mechanism according to claim 1, wherein it includes several gongs arranged with no contact one above the other, one end of each gong being secured to the same gong-carrier, and each gong defining at least one portion of a circle or portion of a rectangle above the bottom plate and around a watch movement, and wherein the insulator part, rotatably mounted on the bottom plate around an approximately perpendicular axis to the plate, includes a number of U-shaped sectors matching the number of gongs, so that each sector comes into contact on an intermediate portion of the corresponding gong in an idle mode and is at a distance from each gong in striking mode.

13. The striking mechanism according to claim 12, wherein it includes an opposite insulator counterpart rotatably mounted on the bottom plate and driven via the insulator part, the opposite counterpart and the insulator part forming a clamp for imprisoning the intermediate portion of each gong between the sectors of the insulator part and a rod of the opposite insulator counterpart, in an idle mode.

14. The striking mechanism according to claim 12, wherein it includes three gongs of different length and/or section, and three hammers mounted on the bottom plate, each hammer being for striking the corresponding gong, and wherein the insulator arrangement also includes an insulator element rotatably mounted on the bottom plate and arranged diametrically opposite the insulator part, the insulator element being driven by the drive means so that a U-shaped portion of the insulator element comes into contact with the gong located between the other two gongs in an idle mode and is at a distance from the gong in striking mode.

15. The striking mechanism according to claim 1, wherein at least one portion of the insulator part and the opposite counterpart, which comes into contact with the gong(s) is made of an elastically deformable plastic material.

* * * * *